US005778780A

United States Patent [19]

Miller

[11] Patent Number: 5,778,780

[45] Date of Patent: Jul. 14, 1998

[54] PRINTING PRESS WITH NIP ADJUSTMENT

[75] Inventor: John Jarrett Miller, North Richland Hills, Tex.

[73] Assignee: Stevens International, Fort Worth, Tex.

[21] Appl. No.: 667,066

[22] Filed: Jun. 20, 1996

[51] Int. Cl.[6] ..... B41F 5/00

[52] U.S. Cl. ..... 101/216; 101/181; 101/247

[58] Field of Search ..... 101/183, 216, 101/247, 219, 136, 137, 138, 140, 181, 182

[56] References Cited

U.S. PATENT DOCUMENTS

| | | | |
|---|---|---|---|
| 3,612,677 | 10/1971 | Langdon et al. | 355/4 |
| 3,732,813 | 5/1973 | Vir Singh et al. | 101/216 |
| 3,835,772 | 9/1974 | Springer | 101/116 |
| 3,987,726 | 10/1976 | Corse | 101/218 |
| 5,074,205 | 12/1991 | Morgan | 101/181 |
| 5,111,744 | 5/1992 | Wieland | 101/216 |
| 5,272,979 | 12/1993 | Guarino et al. | 101/218 |

*Primary Examiner*—Christopher A. Bennett

*Attorney, Agent, or Firm*—Tarolli, Sundheim, Covell, Tumino & Szabo

[57] ABSTRACT

A printing press has a replaceable cassette removably mounted on a frame. An impression cylinder cooperates with a printing cylinder in the cassette to define a nip through which sheet material moves during printing on the sheet material. The impression cylinder is movable relative to the frame between a retracted position in which the impression cylinder is offset to one side of the cassette and a printing position in which the impression cylinder extends into the cassette. In addition, a manually actuatable mechanism is provided to simultaneously adjust the size of opposite ends of a gap at the nip between the printing cylinder and the impression cylinder.

10 Claims, 5 Drawing Sheets

PRINTING PRESS WITH NIP ADJUSTMENT

BACKGROUND OF THE INVENTION

The present invention relates to a printing press and more particularly to a printing press having an adjustable nip between a printing cylinder and an impression cylinder.

A known offset printing press includes a plate cylinder, a blanket cylinder and an impression cylinder. The plate cylinder transfers an ink image to the blanket cylinder. The blanket cylinder transfers the ink image to sheet material supported by the impression cylinder. A nip between the impression cylinder and blanket cylinder is adjustable to accommodate different thicknesses of sheet material and to obtain different printing pressures on the sheet material. In this known printing press, opposite ends of the nip between the plate and blanket cylinders are sequentially adjusted.

SUMMARY OF THE INVENTION

A printing press for printing on sheet material has a printing cylinder and an impression cylinder which cooperate to define a nip through which sheet material moves during printing on the sheet material. The impression cylinder is movable between a retracted position in which it is spaced from the printing cylinder and a printing position in which it is adjacent to the printing cylinder and cooperates with the printing cylinder to define the nip through which the sheet material moves. A nip adjustment mechanism is provided to simultaneously adjust the height of the nip at each end of the nip.

The printing cylinder may be disposed in a replaceable cassette which is removably mounted on the frame of the printing press. When the impression cylinder is in the retracted position, the cassette can be removed from the frame of the printing press. When the impression cylinder is in printing position, it extends into the cassette and cooperates with the printing cylinder to define the nip through which the sheet material moves.

BRIEF DESCRIPTION OF THE DRAWINGS

The foregoing and other features of the present invention will become more apparent upon a consideration of the following description taken in connection with the accompanying drawings, wherein.

DESCRIPTION OF ONE SPECIFIC PREFERRED EMBODIMENT OF THE INVENTION

General Description

Figure 2:
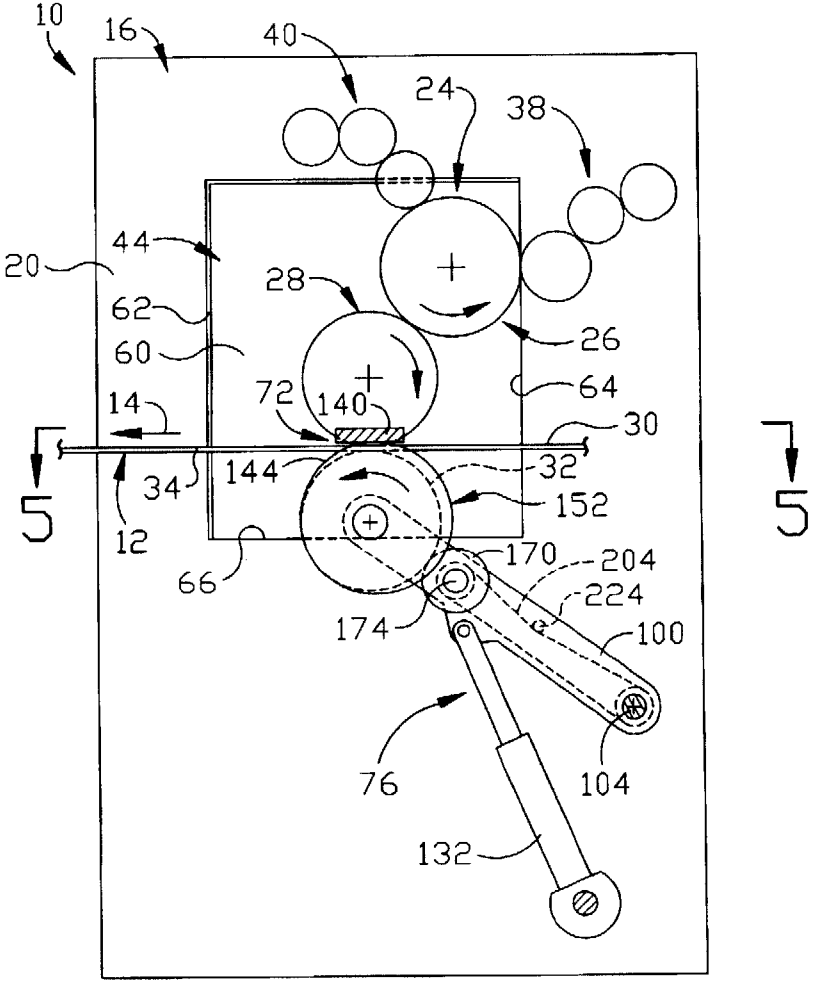
FIG. 2 is a schematic illustration, generally similar to FIG. 1, illustrating the impression cylinder in a printing position in which it cooperates with the printing cylinder to form a nip through which sheet material passes.

A printing press 10 (FIGS. 1 and 2) is operable to print on sheet material 12 (FIG. 2). The sheet material 12 may be individual sheets of material or a web of sheet material. The sheet material 12 may be formed of paper, polymeric materials or other substances. During printing on the sheet material 12 with the printing press 10, the sheet material travels through the printing press from right to left, in the manner indicated by an arrow 14 in FIG. 2.

The printing press 10 has a frame 16. The frame 16 has a pair of parallel side sections between which the sheet material 12 moves. Thus, the frame 16 includes an operator side section 18 (FIG. 1) and a gear side section 20 (FIG. 2). The upright operator side section 18 and gear side section 20 are interconnected by a base section (not shown) and extend parallel to each other.

A printing unit 24 is supported between the operator side section 18 and gear side section 20 of the frame 16. Although the printing unit 24 could have many different known constructions, the printing unit is of the well known offset lithographic type. Therefore, the illustrated printing unit 24 includes a plate cylinder 26 and a blanket cylinder 28.

A cylindrical lithographic printing plate is disposed on the rotatable plate cylinder 26. The printing plate has an ink receptive image area to be printed on an upper side surface 30 (FIG. 2) of the sheet material 12 and a nonimage area where the sheet material 12 is to be free of ink. The image area on the lithographic printing plate is ink receptive while the nonimage area on the printing plate is ink rejecting.

The blanket cylinder 28 has an outer side surface which is disposed in engagement with the printing plate on the plate cylinder 26. A blanket, having a known construction, is mounted on the blanket cylinder 28 and has a cylindrical outer side surface which receives an ink image from the printing plate on the plate cylinder 26. The blanket cylinder 28 applies the ink image to an upper side surface 30 of the sheet material 12 while the sheet material is supported by an impression cylinder 32.

The impression cylinder 32 has a hard cylindrical metal outer side surface which engages a lower side 34 of the sheet material 12. The plate cylinder 26, blanket cylinder 28 and impression cylinder 32 are rotatable about parallel axes which extend perpendicular to the side sections 18 and 20 of the frame 16.

A known dampener 38 applies damping solution to the printing plate on the plate cylinder 26. The dampening solution keeps the nonimage areas on the printing plate water receptive and ink repellant. A known inker 40 applies an ink film to the ink receptive image areas of the printing plate on the plate cylinder 26. The dampener 38 and inker 40 may have any one of many well known constructions and cooperate with the plate cylinder 26 in a known manner. The dampener 38 and inker 40 have rolls which are rotatably supported by the side sections 18 and 20 of the frame 16.

Although the printing unit 24 is of the well known indirect or offset lithographic type, it is contemplated that other known types of printing units could be utilized. For example, the blanket cylinder 28 could be omitted and the ink image applied directly to the sheet material 12 by the plate cylinder 26. Thus, the printing unit 24 could be constructed so that the printing cylinder which applies the ink to the sheet material 12 is a plate cylinder. While the printing unit 24 of the lithographic type which includes a dampener 38, it is contemplated that the printing unit could be of the waterless type if desired. If desired, images may be printed on the sheet material 12 with printing material other than ink.

The plate cylinder 26 and blanket cylinder 28 are rotatably mounted in a rectangular cassette 44. The cassette 44 is removably mounted on the frame 16. It is contemplated that a plurality of cassettes 44 may be associated with the printing press 10. Each of the cassettes 44 will contain a plate cylinder 26 and blanket cylinder 28. Different printing plates will be provided on the plate cylinders 26 in different cassettes. Therefore, a first one of the plurality of cassettes may be used to print a first image on the sheet material 12. A second cassette may subsequently be used to print a different image on sheet material. The use of the removable cassettes 44 enables the printing press 10 to be quickly changed from printing one image to printing another image.

The cassette 44 includes a generally rectangular operator side end plate 48 (FIG. 1) which is mounted in a rectangular opening 50 formed in the operator side section 18 of the frame 16. The opening 50 in the operator side section 18 of the frame 16 has a vertical side surface 52 and a horizontal side surface 54 which are engaged by the operator side end plate 48 of the cassette 44. Engagement of the operator side end plate 48 with the surfaces 52 and 54 on the operator side section 18 of the frame 16 accurately positions the end plate 48 of the cassette 44 relative to the frame 16.

Similarly, the cassette 44 has a generally rectangular gear side end plate 60 (FIG. 2) which is disposed in an opening 62 formed in the gear side section 20 of the frame 16. The gear side end plate 60 engages a vertical side surface 64 of the opening 62 and a horizontal lower side surface 66 of the opening. Engagement of the gear side end plate 60 of the cassette 44 with the surfaces 64 and 66 of the opening 62 accurately positions the gear side end plate of the cassette relative to the gear side section 20 of the frame 16. The operator and gear side end plates 48 and 60 are interconnected by the plate and blanket cylinders 26 and 28 and suitable frame members (not shown).

A pair of clamp assemblies (not shown) are provided to clamp the cassette end plates 48 and 60 in position in the openings 50 and 62 in the side sections 18 and 20 of the frame 16. Thus, one clamp assembly is provided to clamp the end plate 48 firmly in place in the opening 50 in the operator side section 18 of the frame 16. The end plate 48 is pressed firmly against the vertical side 52 and lower side 54 of the opening 50 by the clamp assembly.

Similarly, a second clamp assembly is provided to hold the opposite or gear side end plate 60 of the cassette in the opening 62 in the gear side section 20 of the frame 16. The second clamp assembly presses the gear side end plate 60 firmly against the vertical side surface 64 and lower surface 66 of the opening 62. The clamp assemblies cooperate with the cassette 44 to maintain the cassette in the desired position relative to the frame 16 during operation of the printing unit 24.

When the cassette 44 is to be removed from the printing press 10, the rolls in the dampener 38 and inker 40 are moved out of engagement with the plate cylinder 26. The impression cylinder 32 is moved from the printing position of FIG. 2 to the retracted position of FIG. 1. The clamp assemblies are actuated to release opposite ends of the cassette 44 for movement relative to the side sections 18 and 20 of the frame 16.

Once this has been done, the cassette 44 is moved out of the frame 16 along a path extending parallel to the central axes of the plate cylinder 26 and blanket cylinder 28. A new cassette 44 is then inserted into the frame 16 and the clamp assemblies operated to the engaged condition to position the cassette relative to the frame. Once this has been done, the rolls in the dampener 38 and inker 40 can be moved into engagement with the plate cylinder 26.

Figure 1:
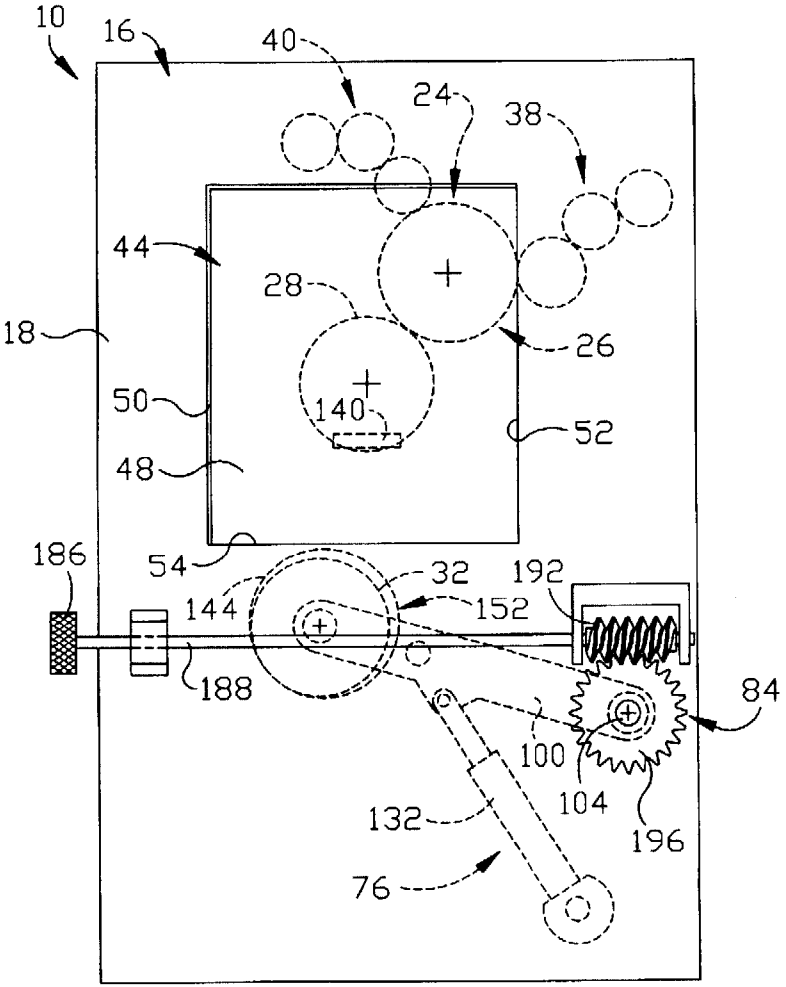
FIG. 1 is a schematic illustration of a printing press and depicting the relationship between a printing cylinder and an impression cylinder when the impression cylinder is in a retracted position.

In accordance with one of the features of the present invention, the impression cylinder 32 is movable between the retracted position of FIG. 1 and the printing position of FIG. 2. When the impression cylinder 32 is in the retracted position of FIG. 1, it is offset to one side of the cassette 44. Therefore, the cassette 44 can be removed from the frame 16 along a path extending parallel to the central axes of the plate cylinder 26, blanket cylinder 28 and impression cylinder 32 without interfering with the impression cylinder.

After a new cassette has been positioned in the frame 16, the impression cylinder 32 is moved from the retracted position of FIG. 1 to the printing position of FIG. 2. When the impression cylinder 32 is in the printing position of FIG. 2, the impression cylinder extends into the cassette 44. At this time, the impression cylinder 32 cooperates with the blanket cylinder 28 to form a printing nip 72 (FIG. 2) through which the sheet material 12 moves during printing on the sheet material by the printing cylinder 28.

When the impression cylinder 32 is in the printing position of FIG. 2, a hard cylindrical outer side surface of the impression cylinder 32 is engageable with the lower side 34 of the sheet material 12. This enables the impression cylinder 32 to support the sheet material and enables printing pressure to be applied against the upper side 30 of the sheet material by the blanket cylinder 28. An impression cylinder positioning mechanism 76 is operable to move the impression cylinder 32 between the retracted position of FIG. 1 and the printing position of FIG. 2.

Figure 3:
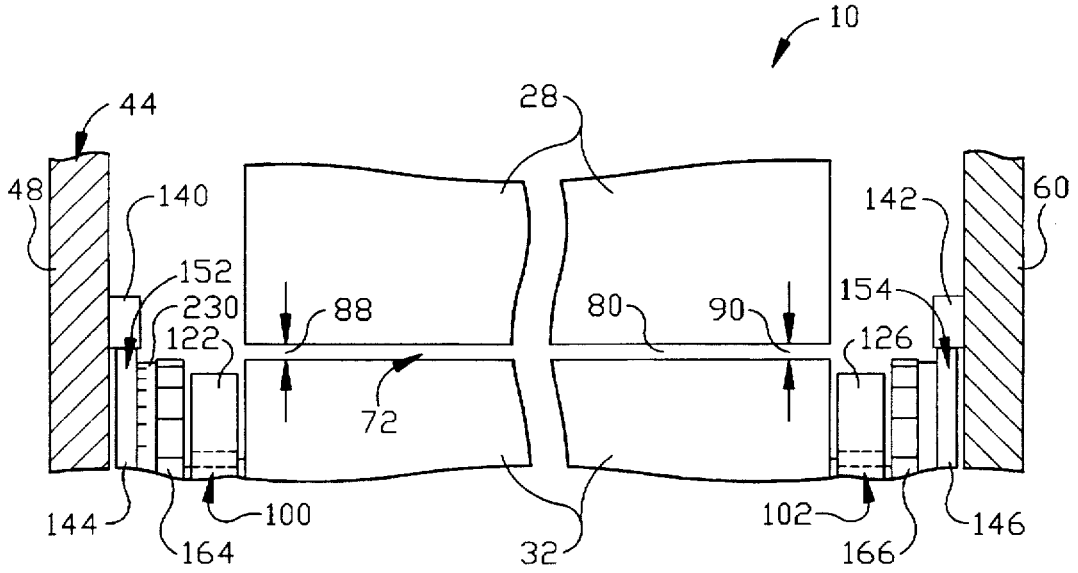
FIG. 3 is a schematic illustration depicting the relationship between opposite ends of a gap at the nip formed between the printing cylinder and impression cylinder when the gap is relatively large.
Figure 4:
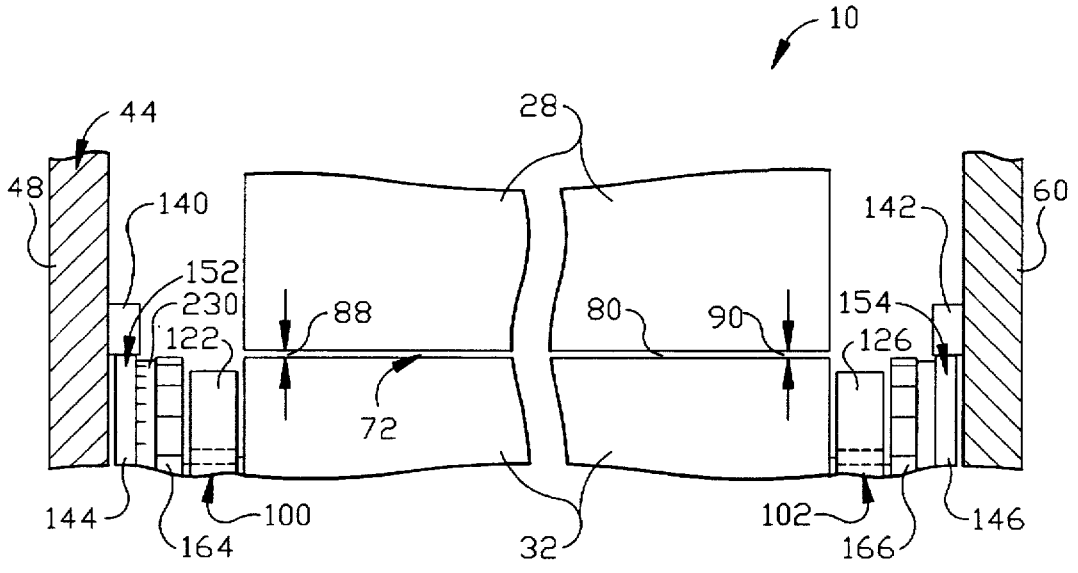
FIG. 4 is a schematic illustration depicting the relationship between opposite ends of the gap at the nip between the printing cylinder and impression cylinder when the gap is relatively small.

The height of opposite ends of a uniform gap 80 (FIGS. 3 and 4) at the printing nip 72 can be simultaneously adjusted. When the printing press 10 is to print on relatively thick sheet material, the height of the gap 80 at the printing nip 72 is relatively large (FIG. 3). When the printing press 10 is to print on relatively thin sheet material, the height of the gap 80 at the printing nip 72 is relatively small (FIG. 4). The heights of opposite ends of the nip 72 are measured along lines which extend perpendicular to and intersect the parallel central axes of the blanket cylinder 28 and impression cylinder 32. The nip 72 has the same height throughout the length of the nip.

In accordance with one of the features of the present invention, a nip adjustment mechanism 84 is operable to simultaneously adjust the height of the nip 72 at opposite ends of the nip. The nip adjustment mechanism 84 (FIG. 1) is mounted on the operator side section 18 of the frame 16. The nip adjustment mechanism 84 is operable to move the impression cylinder 32 relative to the printing or blanket cylinder 28 while maintaining the central axis of the impression cylinder parallel to the central axis of the blanket cylinder. Therefore, the height of opposite ends of the nip 72 are simultaneously varied by the same amount during operation of the nip adjustment mechanism 84.

For example, when the size of the nip 72 is to be reduced from the relatively large size of FIG. 3 to the relatively small size of FIG. 41 the nip adjustment mechanism 84 is operated to reduce the distance between the impression cylinder 32 and the printing cylinder 28 when the impression cylinder is moved to the printing position of FIG. 2. This results in an end portion 88 of the gap 80 adjacent to the operator side end plate 48 of the cassette 44 being decreased in size from the relatively large dimension indicated by the arrows in FIG. 3 to the relatively small dimension indicated by the arrows in FIG. 4. An end portion 90 of the nip 72 adjacent to the gear side end plate 60 of the cassette 44 is simultaneously changed from the relatively large size of FIG. 3 to the relatively small size of FIG. 4. Thus, the height of the end portion 90 of the gap 80 is decreased by the same amount and at the same time as the end portion 88 of the gap.

It is contemplated that the impression cylinder positioning mechanism 76 and/or nip adjustment mechanism 84 may be used in many different types of printing presses. For example, the impression cylinder positioning mechanism 76 and/or nip adjustment mechanism 84 could be used in association with a cassette containing only a single printing cylinder which does not use conventional ink to print on sheet material. The impression cylinder positioning mechanism 76 and/or nip adjustment mechanism 84 could be used in printing presses in which the printing unit 24 is directly mounted on the side sections 18 and 20 of the frame 16 of the printing press. The nip adjustment mechanism 84 could be operated to adjust the size of the nip 72 when the impression cylinder 32 is in the retracted position of FIG. 1 or the printing position of FIG. 2.

Impression Cylinder Positioning Mechanism

The impression cylinder positioning mechanism 76 (FIGS. 5 and 6) is operable to move the impression cylinder 32 between the retracted position of FIG. 1 and the printing position of. FIG. 2. When the impression cylinder 32 is in the retracted position of FIG. 1, it is offset to one side of the cassette 44. The cassette can then be removed from the printing press 10 along a path parallel to the central axis of the impression cylinder 32. When the impression cylinder 32 is in the printing position of FIG. 2, it extends into the cassette 44 and cooperates with the printing cylinder 28 to form the nip 72 where an image is applied to sheet material 12.

Figure 5:
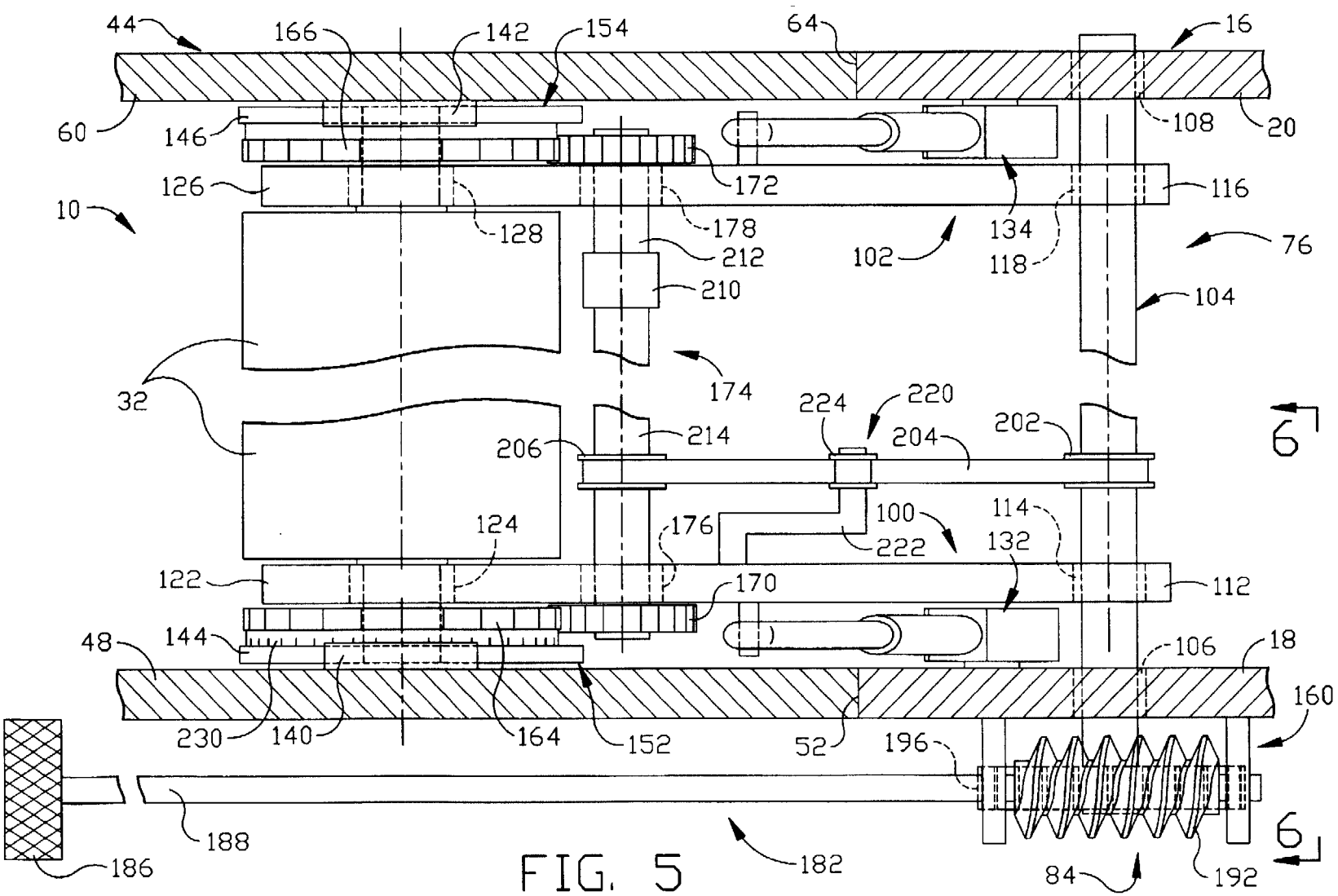
FIG. 5 is a schematic sectional view, taken generally along the line 5—5 of FIG. 2, illustrating the relationship between an impression cylinder positioning mechanism and a nip adjustment mechanism in the printing press.

The impression cylinder positioning mechanism 76 illustrated in FIG. 5 includes a pair of parallel swing arms 100 and 102. The swing arms 100 and 102 are rotatable relative to a cylindrical swing arm pivot shaft 104. The swing arm pivot shaft 104 is rotatably mounted on the operator side section 18 of the frame 16 by a bearing 106. The opposite end of the swing arm pivot shaft 104 is rotatably mounted on the gear side section 20 of the frame 16 by a bearing 108.

A lower (as viewed in FIGS. 1 and 2) end portion 112 (FIG. 5) of the swing arm 100 is rotatably mounted on the swing arm pivot shaft 104 by a bearing 114. Similarly, a lower end portion 116 of the swing arm 102 is rotatably mounted on the swing arm pivot shaft 104 by a bearing 118. The bearings 114 and 118 enable the swing arms 100 and 102 to be pivoted relative to the swing arm pivot shaft 104 without rotating the swing arm pivot shaft. Similarly, the swing arm pivot shaft 104 can be rotated relative to the swing arms 100 and 102 without pivoting the swing arms.

The swing arm pivot shaft 104 (FIG. 5) has a central axis which extends perpendicular to the operator and gear side sections 18 and 20 of the frame 16 and parallel to the central axis of the impression cylinder 32. The impression cylinder 32 is rotatably mounted on an upper, as viewed in FIGS. 1 and 2, end portion 122 (FIG. 5) of the swing arm 100 by bearing 124. Similarly, the opposite end of the impression cylinder 32 is mounted on an end portion 126 of the swing arm 102 by a bearing 128. The bearings 124 and 128 support the impression cylinder 32 for rotation about a central axis of the impression cylinder.

The central axis of the impression cylinder 32 extends perpendicular to and extends through the end plates 48 and 60 of the cassette 44 when the impression cylinder 32 is in the printing position shown in FIGS. 2 and 5. Since the central axis of the impression cylinder 32 is maintained parallel to the central axis of the blanket cylinder 28 (FIGS. 1 and 2) at all times, the central axis of the swing arm pivot shaft 104 (FIG. 5) is parallel to the central axis of the blanket cylinder 28. Therefore, pivotal movement of the swing arms 100 and 102 about the swing arm pivot shaft 104 moves the impression cylinder 32 toward or away from the blanket cylinder 28 with the central axis of the impression cylinder parallel to the central axis of the blanket cylinder.

A pair of motors 132 and 134 (FIG. 5) are connected with the swing arms 100 and 102. The motors 132 and 134 are piston and cylinder type hydraulic motors. Suitable controls effect simultaneous extension of the hydraulic motors 132 and 134 at the same rate to pivot the swing arms 100 and 102 in a clockwise direction (as viewed in FIGS. 1 and 2) about the swing arm pivot shaft 104. Similarly, the motors 132 and 134 are retracted to pivot the swing arms 100 and 102 in a counterclockwise direction (as viewed in FIGS. 1 and 2) about the pivot shaft 104.

Identical stop members 140 and 142 (FIGS. 3, 4 and 5) are fixedly secured to the end plates 48 and 60 of the cassette 44. The stop members 140 and 142 engage annular positioning surfaces 144 and 146 connected with the impression cylinder 32. The stop members 140 and 142 block upward movement of the swing arms 100 and 102 when the impression cylinder 32 is in a desired printing position relative to the blanket cylinder 28.

The stop members 140 and 142 cooperate with the positioning surfaces 144 and 146 to accurately locate the impression cylinder 32 relative to the blanket cylinder 28. Since the stop members 140 and 142 are fixedly secured to the end plates 48 and 60 of the cassette 44, the stop members can be accurately positioned relative to the central axis of the blanket cylinder 28 during construction of the cassette 44. If desired, the stop members 140 and 142 could be mounted on the side sections 18 and 20 of the frame 16 rather than in the cassette 44. However, it is believed that it will be preferred to position the stop members 140 and 142 in the cassette 44 where they can be accurately positioned relative to the blanket cylinder 28 with a minimum of difficulty.

In the illustrated embodiment of the impression cylinder positioning mechanism 76, the impression cylinder 32 is rotatably mounted on swing arms 100 and 102 for movement relative to the frame 16. However, it is contemplated that the impression cylinder 32 could be rotatably supported in a different manner if desired. For example, the impression cylinder 32 could be rotatably supported on slides which are movable along linear paths relative to the frame 16.

Nip Adjustment Mechanism

The nip adjustment mechanism 84 is manually actuatable to simultaneously adjust the height of opposite ends of the nip 72 between the blanket cylinder 28 and impression cylinder 32. This enables the size of the uniform gap 80 at the printing nip 72 (FIGS. 3 and 4) to be adjusted between the relatively large gap of FIG. 3 and the relatively small gap of FIG. 4. The central axis of the impression cylinder 32 is maintained parallel to the central axis of the blanket cylinder 28 to enable the height of axially opposite end portions 88 and 90 of the nip 72 to be simultaneously adjusted.

The nip adjustment mechanism 84 (FIG. 5) includes a pair of cams 152 and 154 (FIG. 5) which are connected with axially opposite ends of the impression cylinder 32. The annular positioning surface 144 is disposed on the periphery of the cam 152. Similarly, the annular positioning surface 146 is disposed on the periphery of the cam 154.

The cams 152 and 154 are simultaneously rotatable about the central axis of the impression cylinder 32. However, the circular positioning surfaces 144 and 146 have coincident central axes which are offset or eccentric to the central axis of the impression cylinder 32. The positioning surfaces 144 and 146 engage the stop members 140 and 142 to accurately locate the impression cylinder 32 relative to the blanket cylinder 28.

The coincident central axes of the cams 152 and 154 extend parallel to and are offset from the central axis of the impression cylinder 32. Therefore, rotation of the cams 152 and 154 about the central axis of the impression cylinder 32 changes the distance between the locations on the positioning surfaces 144 and 146 which engage the stop members 140 and 142 and the central axis of the impression cylinder 32. By simultaneously rotating the cams 152 and 154, it is possible to simultaneously adjust the height of the printing nip 72 at opposite ends of the nip by the same amount.

Figure 6:
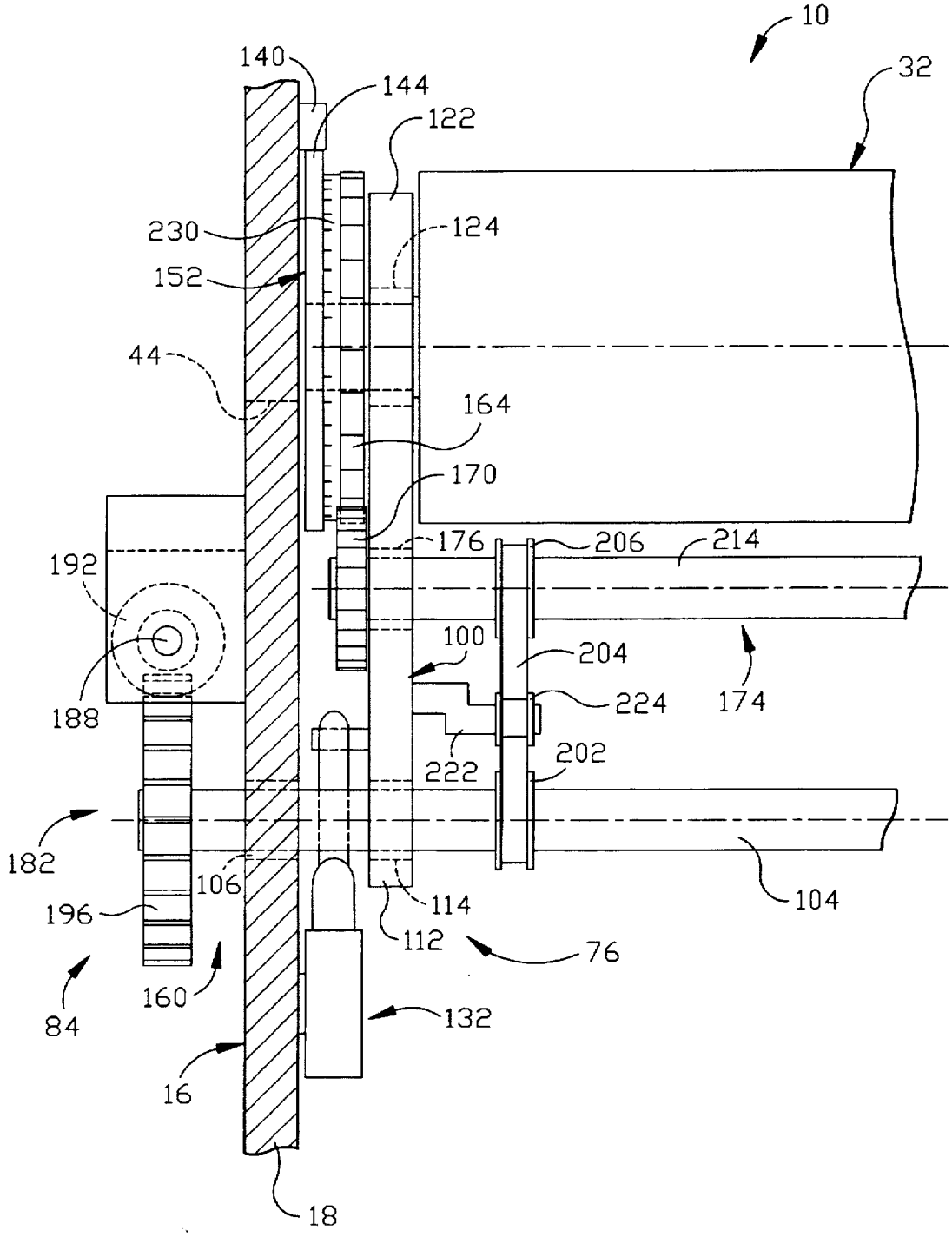
FIG. 6 is an elevational sectional view, taken generally along the line 6—6 of FIG. 5, further illustrating the relationship between the impression cylinder positioning mechanism and the nip adjustment mechanism.

The nip adjustment mechanism 84 includes a cam drive assembly 160 (FIGS. 5 and 6). The cam drive assembly 160 is operable to rotate the cams 152 and 154 through equal angular distances about the central axis of the impression cylinder 32. Therefore, operation of the cam drive assembly 160 effects equal changes in the height of opposite ends 88 and 90 of the gap 80 at the printing nip 72 (FIGS. 3 and 4).

The cam drive assembly 160 includes main gears 164 and 166 (FIG. 5) which are fixedly connected with the cams 152 and 154. Thus, the main drive gear 164 is fixedly connected with the cam 152. The main drive gear 164 has a central axis which is coincident with the central axis of the impression cylinder 32 and is offset from the central axis of the cam 152. Similarly, the main drive gear 166 is fixedly connected with the cam 154. The main drive gear 166 has a central axis which is coincident with the central axis of the impression cylinder 32 and is offset from the central axis of the cam 154.

Drive gears 170 and 172 are disposed in meshing engagement with the main gears 164 and 166. The drive gears 170 and 172 are fixedly connected to a cross shaft 174 having a central axis which extends parallel to the central axis of the impression cylinder 32. The cross shaft 174 is rotatably mounted in circular openings in the swing arms 100 and 102 by bearings 176 and 178. The central axis of the cross shaft 174 extends parallel to the central axis of the swing arm pivot shaft 104.

The cross shaft 174 and drive gears 170 and 172 are manually rotatable by a drive train 182 (FIG. 5). The drive train 182 includes a manually rotatable input knob 186 which is fixedly connected to one end of an input shaft 188. The opposite end of the input shaft 188 is fixedly connected with a worm 192. The worm 192 has a central axis which is coincident with the central axis of the input shaft 188. Therefore, rotation of the input knob 186 is effective to rotate the worm 192 about its central axis.

The worm 192 is rotatably supported on the operator side section 18 of the frame 16. The worm 192 is disposed in meshing engagement with a worm gear 196 (FIG. 6). The worm gear 196 is fixedly connected with the swing arm pivot shaft 104 at a location outside of and adjacent to the operator side section 18 of the frame 16. Rotation of the worm 192 rotates the worm gear 196 and the swing arm pivot shaft 104 relative to the frame 16. In the absence of rotation of the worm 192, the worm is effective to hold the worm gear 196 and swing arm pivot shaft 104 against rotation relative to the frame 16.

An externally toothed timing pulley 202 (FIGS. 5 and 6) is fixedly connected with the swing arm pivot shaft 104. A toothed timing belt 204 engages the timing pulley 202. The toothed timing belt 204 also engages an externally toothed timing pulley 206 which is fixedly connected to the cross shaft 174.

Upon rotation of the swing arm pivot shaft 104 by the worm gear 196, the timing pulley 202 drives the timing belt 204 to rotate the cross shaft 174. Since the drive gears 170 and 172 (FIG. 5) are fixedly connected to opposite ends of the cross shaft 174, rotation of the timing pulley 206 by the timing belt 204 is effective to rotate the two drive gears 170 and 172 through the same angular distance relative to the swing arms 100 and 102. Rotation of the drive gears 170 and 172 rotates the main gears 164 and 166 which are fixedly connected with the cams 152 and 154. The main gears 164 and 166 and cams 152 and 154 are rotated through the same arcuate distance relative to the stop members 140 and 142 by the drive gears 170 and 172.

A timing coupling 210 (FIG. 5) interconnects sections 212 and 214 of the cross shaft 174. Upon disengagement of the timing coupling 210, the sections 212 and 214 of the cross shaft 174 can be rotated relative to each other. This enables the cams 152 and 154 to be accurately positioned relative to each other so that corresponding areas on both cams engage the stop members 140 and 142 when the impression cylinder 32 is in the printing position shown in FIG. 2. Once the cams 152 and 154 (FIG. 5) have been accurately positioned relative to each other, the timing coupling 210 is engaged to fixedly interconnect the sections 212 and 214 of the cross shaft 174.

A tension adjustment mechanism 220 is provided to maintain a desired tension in the timing belt 204 (FIG. 5). The tension adjustment mechanism 220 includes a spring biased tension arm 222 which is pivotally mounted on the swing arm 100. An idler pulley 224 on the outer end of the tension arm 222 is pressed against the timing belt 204 by a biasing spring (not shown) connected between the tension arm 222 and the swing arm 100. The force applied against the timing belt 204 by the idler puller 224 maintains a desired tension in the timing belt.

An indicator dial 230 (FIGS. 5 and 6) is fixedly connected with the cam 152. The drive gears 170 and 172 (FIG. 5) and cross shaft 174 interconnect the main gears 164 and 166. Since the cam 152 and indicator dial 230 are fixedly connected with the main gear 164, the indicator dial is effective to indicate the positions of both the cam 152 and the cam 154 relative to the impression cylinder 32. Although only a single indicator dial 230 is fixedly connected with the cam 152, a second indicator dial could be connected with the cam 154 if desired.

Figure 7:
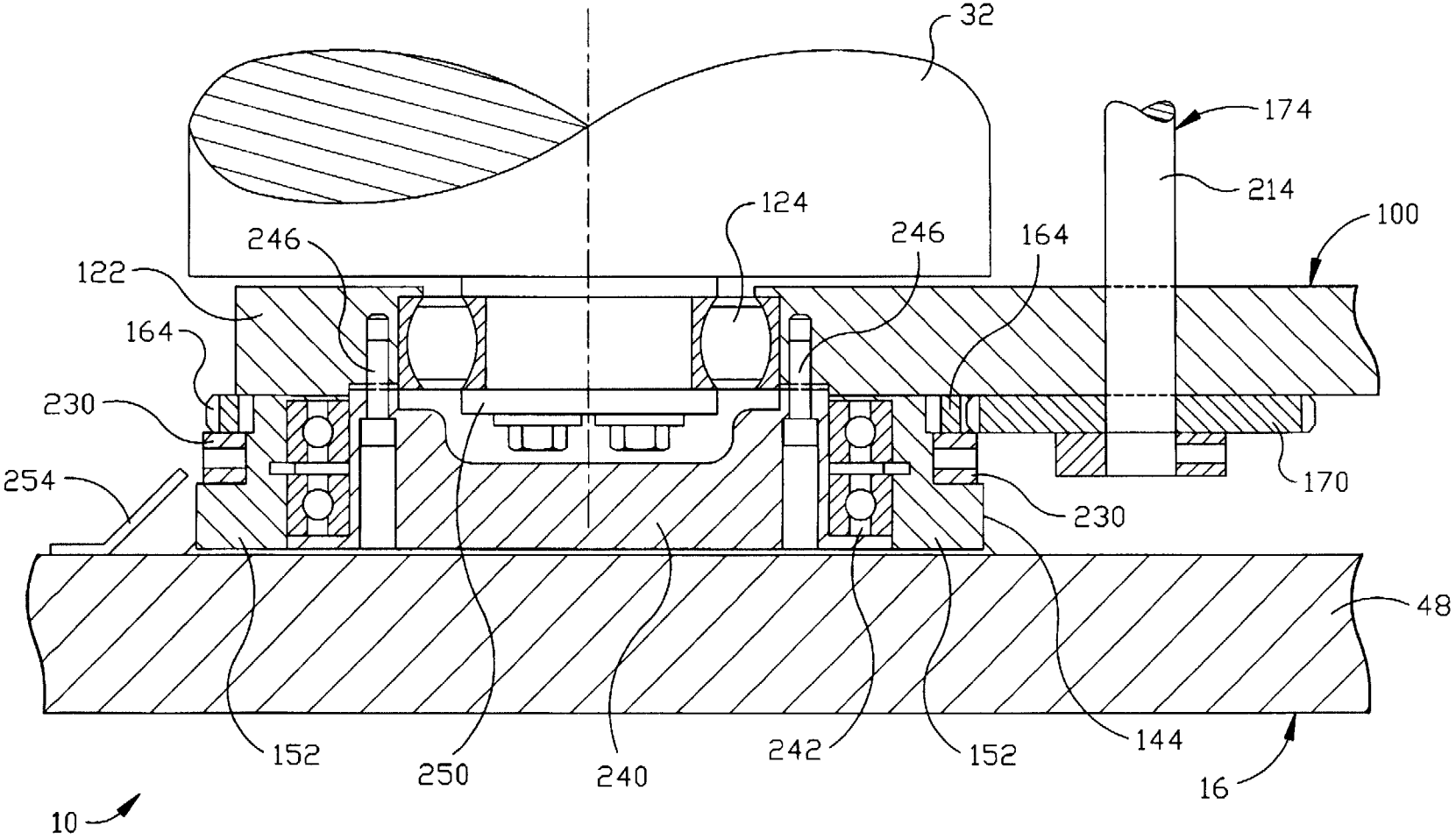
FIG. 7 is a fragmentary sectional view illustrating the manner in which the impression cylinder positioning mechanism and nip adjustment mechanism are connected with each other and with the impression cylinder.

The manner in which the indicator dial 230 and main gear 164 are mounted on and fixedly connected with the cam 152 is illustrated in FIG. 7. A plurality of set screws are provided to fixedly secure the indicator dial 230 to the cam 152. Internal teeth on the main gear 164 mesh with external teeth on the cam 152 to hold the main gear 164 against rotation relative to the cam. Alternatively, the gear 164 could be press fit onto the cam 152. The cam 152, indicator dial 230 and main gear 164 are all rotatably supported on a cam bearing mount 240 by a bearing assembly 242 (FIG. 7). The cam bearing mount 240 is fixedly secured to the upper end portion 122 of the swing arm 100 by suitable bolts 246.

One axial end portion of the impression cylinder 32 is rotatably mounted on the outer end portion 122 of the swing arm 100 by the bearing 124. The cam bearing mount 240 cooperates with a bearing retainer 250 to hold the bearing 124 in place on the swing arm 100. The cam 154 and main gear 166 are rotatably mounted on the upper end portion 126 of the swing arm 102 in the same manner as in which the cam 152 and main gear 164 are rotatably mounted on the swing arm 100.

A pointer 254 (FIG. 7) is mounted on the cassette end plate 48 to enable an operator to determine the position of the cam 152 relative to the swing arm 100 when the impression cylinder 32 is in the printing position of FIG. 2. This facilitates operating the nip adjustment mechanism 84 when the impression cylinder 34 is in the printing position. A second pointer, similar to the pointer 254 (FIG. 7) and a second indicator dial, similar to the indicator dial 230, could be provided in association with the cam 154 if desired.

If desired, the pointer 254 (FIG. 7) may be fixedly connected with an inner side of the frame section 18. The indicator dial 230 would then be adjacent to the pointer 254 when the impression cylinder 32 is in the retracted position of FIG. 1. An operator could view the relationship between the pointer 254 and the cam indicator dial 230 by looking along the inner side of the operator side section 18 of the frame 16. This would enable the operator to determine the location of the indicator dial 230 and cam 152 relative to the swing arm 100. Of course, the cam 154 (FIG. 5) is in the same position relative to the swing arm 102. If desired, pointers corresponding to the pointer 254 could be provided on both the cassette end plate 48 and the frame section 18.

Operation

At the end of one printing operation and prior to the beginning of the next printing operation, the impression cylinder positioning mechanism 76 (FIG. 5) is operated to move the impression cylinder 32 from the printing position of FIG. 2 to the retracted position of FIG. 1. To move the impression cylinder 32 from the printing position to the retracted position, the motors 132 and 134 (FIG. 5) are operated from the extended condition to a retracted condition. As this occurs, the swing arms 100 and 102 are pivoted about the swing arm pivot shaft 104 and the impression cylinder 32 is moved out of the cassette 44 to the retracted position shown in FIG. 1.

After the impression cylinder 32 has been moved to the retracted position (FIG. 1), the cassette 44 can be withdrawn from the frame 16 without interference with the impression cylinder. A new cassette 44 containing a blanket cylinder 28 and a plate cylinder 26 with a different printing plate is then moved into the frame 16. Once the new cassette 44 has been clamped into position in the frame 16, the impression cylinder 32 can be moved from the retracted position of FIG. 1 back to the printing position of FIG. 2.

The impression cylinder positioning mechanism 76 is operated to move the impression cylinder upward from the retracted position of FIG. 1 toward the printing position of FIG. 2. As this occurs, the swing arms 100 and 102 are pivoted about the stationary swing arm pivot shaft 104. The cams 152 and 154 move into engagement with the stop members 140 and 142 in the new cassette 44. Engagement of the positioning surfaces 144 and 146 on the cams 152 and 154 with lower side surfaces on the stop members 140 and 142 accurately positions the impression cylinder 32 relative to the blanket cylinder 28.

The printing nip 72 (FIG. 3) between the blanket cylinder 28 and the impression cylinder 32 will have the same height at opposite end portions 88 and 90 of the nip. Thus, the height of opposite ends of the nip 72 will correspond to the positions of the cams 152 and 154.

Upon movement of the impression cylinder 32 from the retracted position of FIG. 1 to the printing position of FIG. 2, the nip adjustment mechanism 84 may be operated. Operation of the nip adjustment mechanism 84 simultaneously adjusts the height of opposite end portions 88 and 90 (FIGS. 3 and 4) of the gap 80.

Thus, while the impression cylinder 32 is stationary in the printing position of FIG. 2, the input knob 186 is manually rotated to rotate the input shaft 188 and worm 192 (FIG. 5). Rotation of the worm 192 rotates the worm gear 196 and swing arm pivot shaft 104 (FIG. 6) relative to the frame 16. As this occurs, the timing belt 204 rotates the cross shaft 174 and drive gears 170 and 172 (FIGS. 5 and 6) relative to the stationary swing arms 100 and 102. As the drive gears 170 and 172 are rotated relative to the swing arms, the main gears 164 and 166 and cams 152 and 154 are simultaneously rotated through the same arcuate distance relative to the swing arms 100 and 102 by the drive gears.

When the indicator dial 230 has moved to a desired position relative to the pointer 254 (FIG. 7), manual rotation of the input knob 186 is interrupted. The cams 152 and 154 will then have been positioned in a desired orientation relative to the stationary swing arms 100 and 102.

It is preferred to rotate the cams 152 and 154 to simultaneously adjust the height of opposite ends 88 and 90 of the nip 72 while the impression cylinder 32 is in the printing position of FIG. 2. However, the nip adjustment mechanism 84 could be actuated while the impression cylinder 32 is in the retracted position of FIG. 1 to simultaneously adjust the height of the opposite end portions 88 and 90 of the nip 72 if desired. The nip adjustment mechanism 84 is manually actuated. However, the nip adjustment mechanism 84 could be actuated by a suitable motor if desired.

Conclusion

In view of the foregoing description, it is apparent that the present invention provides a new and improved printing press 10 for printing on sheet material 12. The printing press 10 has a printing cylinder 28 and an impression cylinder 32 which cooperate to define a nip 72 through which sheet material 12 moves during printing on the sheet material. The impression cylinder 32 is movable between a retracted position (FIG. 1) in which it is spaced from the printing cylinder 28 and a printing position (FIG. 2) in which it is adjacent to the printing cylinder and cooperates with the printing cylinder to define the nip 72 through which the sheet material 12 moves. A nip adjustment mechanism 84 is provided to simultaneously adjust the height of the nip 72 at each end 88 and 90 of the nip.

The printing cylinder 28 may be disposed in a replaceable cassette 44 which is removably mounted on the frame 16 of the printing press 10. When the impression cylinder 32 is in the retracted position (FIG. 1), the cassette 44 can be removed from the frame 16 of the printing press 10. When the impression cylinder 32 is in printing position (FIG. 2), it extends into the cassette 44 and cooperates with the printing cylinder 28 to define the nip 72 through which the sheet material 12 moves.

Having described the invention, the following is claimed:

1. A printing press for printing on sheet-like material, said printing press comprising:

a frame;

a replaceable cassette removably mounted on said frame and including a printing cylinder;

an impression cylinder having first and second axially opposite ends;

means for pivotally mounting said impression cylinder on said frame for pivotal movement between a retracted position in which said impression cylinder is offset to one side of said cassette and a printing position in which said impression cylinder extends into said cassette, said printing cylinder and said impression cylinder defining a nip through which the sheet-like material moves during printing on the sheet-like material when said impression cylinder is in the printing position, said nip having a gap with a first end adjacent to the first end of said impression cylinder and a second end adjacent to the second end of said impression cylinder; and manually actuatable means for simultaneously adjusting the size of the first and second ends of the gap at the nip between said printing cylinder and said impression cylinder, said manually actuatable means including a manually actuatable input member which remains stationary relative to said frame when said impression cylinder is pivoted between said retracted position and said printing position.

2. A printing press as set forth in claim 1 wherein said means for simultaneously adjusting the size of the first and second ends of the gap at the nip between said printing cylinder and said impression cylinder further includes first adjustment means for changing the position of the first end of said impression cylinder relative to said printing cylinder when said impression cylinder is in the printing position, second adjustment means for changing the position of the second end of said impression cylinder relative to said printing cylinder when said impression cylinder is in the printing position, and rotatable drive means extending between said first and second adjustment means for effecting simultaneous operation of said first and second adjustment means.

3. A printing press as set forth in claim 2 wherein said first adjustment means includes a first cam member connected with said first end of said impression cylinder and said second adjustment means includes a second cam member connected with said second end of said impression cylinder.

4. A printing press as set forth in claim 3 wherein said frame includes a first side section and a second side section which is spaced from said first side section, said cassette having a first end portion which is fixedly connected to said first side section of said frame and a second end portion which is fixedly connected to said second side section of said frame, said cassette having a first stop surface connected with said first end portion of said cassette and a second stop surface connected with said second end portion of said cassette, said first cam member being engageable with said first stop surface and said second cam member being engageable with said second stop surface to position said impression cylinder relative to said printing cylinder.

5. A printing press as set forth in claim 4 wherein said first cam member is rotatable about a central axis of said impression cylinder to adjust the height of said nip adjacent to the first end portion of said impression cylinder and said second cam member is rotatable about a central axis of said impression cylinder to adjust the height of said nip adjacent to the second end portion of said impression cylinder, said first and second cam members being simultaneously rotated about the central axis of said impression cylinder upon operation of said manually actuatable input member to adjust the height of said nip.

6. A printing press as set forth in claim 5 wherein said means for simultaneously adjusting the size of the first and second ends of the gap at the nip between said printing cylinder and said impression cylinder further includes a rotatable pivot shaft rotatably mounted on said first and second side sections of said frame, said pivot shaft being operatively connected to said drive means by timing belt means for rotating said drive means upon rotation of said pivot shaft.

7. A printing press as set forth in claim 6 wherein said pivot shaft is operatively connected to said manually actuatable input member by gear means for transmitting rotational movement of said input member into rotational movement of said pivot shaft.

8. A printing press as set forth in claim 7 wherein said means for movably mounting said impression cylinder on said frame includes a first support member which is connected with said first side section of said frame and a second support member which is connected with said second side section of said frame, said impression cylinder having a first end portion rotatably supported by said first support member and a second end portion rotatably supported by said second support member, said manually actuatable means being connected with said first and second support members, said manually actuatable means includes a manually actuatable input member which is manually movable relative to said frame.

9. A printing press as set forth in claim 3 wherein said means for movably mounting said impression cylinder on said frame includes motor means for moving said first and second support members relative to said frame.

10. A printing press for printing on sheet-like material, said printing press comprising:

a frame;

a replaceable cassette removably mounted on said frame and including a printing cylinder;

an impression cylinder having first and second axially opposite ends;

means for pivotally mounting said impression cylinder on said frame for pivotal movement between a retracted position in which said impression cylinder is offset to one side of said cassette and a printing position in which said impression cylinder extends into said cassette, said printing cylinder and said impression cylinder defining a nip through which the sheet-like material moves during printing on the sheet-like material when said impression cylinder is in the printing position, said nip having a gap with a first end adjacent to the first end of said impression cylinder and a second end adjacent to the second end of said impression cylinder; and manually actuatable means for simultaneously adjusting the size of the first and second ends of the gap at the nip between said printing cylinder and said impression cylinder by simultaneously moving said first and second ends of said impression cylinder.

* * * * *